United States Patent [19]

Stoakes

[11] Patent Number: 4,782,636

[45] Date of Patent: Nov. 8, 1988

[54] WALL STRUCTURES

[76] Inventor: Richard L. Stoakes, "Clouds" Northdown Road, Woldingham, Surrey, England

[21] Appl. No.: 3,414

[22] Filed: Jan. 15, 1987

[30] Foreign Application Priority Data

Jan. 20, 1986 [GB] United Kingdom ..... 8601289
Jun. 16, 1986 [GB] United Kingdom ..... 8614573

[51] Int. Cl.[4] ..... E04H 1/00
[52] U.S. Cl. ..... 52/235; 52/209; 403/5
[58] Field of Search ..... 52/209, 235, 208, 397; 403/5

[56] References Cited

U.S. PATENT DOCUMENTS

| | | | |
|---|---|---|---|
| 3,844,313 | 10/1974 | Arnold | 403/5 X |
| 3,858,375 | 1/1975 | Silvernail | 52/235 |
| 3,940,897 | 3/1976 | Stoakes | 52/403 X |
| 3,978,629 | 9/1976 | Echols, Sr. | 52/235 |
| 4,533,274 | 8/1985 | Moore | 403/31 |
| 4,608,793 | 9/1986 | Yost et al. | 52/235 |

FOREIGN PATENT DOCUMENTS

| | | |
|---|---|---|
| 194779 | 9/1986 | European Pat. Off. . |
| 1459401 | 12/1976 | United Kingdom . |
| 1496482 | 12/1977 | United Kingdom . |

*Primary Examiner*—David A. Scherbel
*Assistant Examiner*—Creighton Smith
*Attorney, Agent, or Firm*—Hopgood, Calimafde, Kalil, Blaustein & Judlowe

[57] ABSTRACT

A curtain wall structure has a series of panels mounted in a framework with loop-form sealing gaskets around the peripheries of the panels. The gaskets are clamped into sealing contact with the panels by frame members that overlap the edges of the panels. The gasket section includes forward and rear portions between which the edges of panel is sandwiched. These portions are connected by a thin web that forms an enclosed space around the periphery of the panel. An external connection leads to that enclosed space for pressure testing the gasket seal. Upper and lower connections can be provided to said space to facilitate venting—in particular of the gap between the layers of a double-glazed panel. The gasket section may include an intermediate portion serving as a spacer between the layers of a double-glazed panel.

9 Claims, 7 Drawing Sheets

WALL STRUCTURES

BACKGROUND OF THE INVENTION

This invention relates to walls in which a frame structure defines a series of cells in which panes or panels (referred hereinafter simply as "panels") are mounted as an infill. The invention also relates to sealing gaskets for curtain wall structures.

Curtain walls, especially when employed in tall buildings, are subjected to severe wind forces which generate large static pressure differentials in relation to the controlled atmosphere in the interior of the building, and in wet conditions these can lead to problems if even minor leakage paths exist across the wall. Extreme differences between internal and external conditions can also give rise to problems of condensation; apart from obvious results, such as the fogging of glass areas, the materials that are sometimes used for the infill panels and sealing devices of curtain wall structures may be sensitive to moisture and if water is allowed to collect around them they can deteriorate.

There is a requirement, therefore, for an effective means of sealing and it would be desirable moreover, to be able to test the quality of the seal in situ.

SUMMARY OF THE INVENTION

According to one aspect of the invention, there is provided a wall structure comprising a series of frame members forming a plurality of cells or spaces in which infill panels are held, and sealing means engaging the panels in order to seal the peripheries of said cells, said sealing means comprising a respective flexible sealing member or gasket for each panel in the form of a closed loop extending around the outer edge of the panel in said cell, the cross-section of the sealing member comprising forward and rearward portions that overlap and seal against the forward and rear edge margins of the panel, and a web connecting said portions and providing therewith an enclosed space that extends around the periphery of the panel.

Preferably, there is at least one externally accessable conduit leading to said enclosed space. Such a conduit, although it may normally be kept sealed off, provides a pressure test point for determining the integrity of the seal.

The invention has particular application to structures which comprise multiple-layer panels such as double-glazing. As access to the panels may be difficult in multi-storey buildings, it is usual in modern constructions to provide pre-sealed double-glazing units which are manufactured under controlled conditions and are tested in the factory. These must be custom-built and they are comparatively expensive as compared with the panel layers themselves. If a structure according to the present invention is provided with multiple-layer panels with an air gap between the layers, the peripheral sealing members may be arranged as a seal across the layers. In the case of a conventional sealed double-glazing unit this means that the unit is provided with a second, back up seal, but it can alternatively be arranged that the peripheral sealing members provide the only seal for the layers. Conventional infill sheet material can then be employed, without any special preparation, to obtain the advantages of sealed double-layered or double-glazed panels. Preferably, at least two said conduits lead to mutually remote regions of the space enclosed by the peripheral sealing members in this case in order to allow a flow through the air gap between the layers, e.g. for draining and venting, having regard to the possibility that during site assembly of the panel infill significant amounts of moisture may be trapped in the air gap.

If provision is to be made for draining moisture from the space enclosed by a peripheral sealing member, that preferably comprises conduit means leading out of the wall and connected to the space through the web of the sealing member at least in the lower region of each cell. It is also possible, however, if there are two or more vertically spaced cells, to drain from cell to cell, discharging only from the lowermost cell.

Should there be a tendency for moisture to collect in the internal spaces of the structure framework although the peripheral sealing members perform their function, the framework may have drainage outlets at least at its lowermost level allowing any collected water to escape.

Preferably, in each said sealing member at least one of said forward and rearward portions has engagement means, conveniently with a locking fit such as a dovetail section, for location of the sealing member on a rigid supporting member.

The frame structure may comprise a series of main frame members connected together to form the skeleton of the structure and auxiliary frame members secured to the main members to hold the panels in place in said cells. The forward portion of each said peripheral sealing member may then comprise an extension arranged to overlap the associated auxiliary frame members, whereby a limb of each auxiliary member can bear against the associated panel through said portion and yet be shielded from the exterior by said extension. By providing an engagement location in the front face of each auxiliary frame member to hold an edge of the extension, the sealing member can be locked against said frame members.

The invention will be described in more detail by way of example with reference to the accompanying drawings.

DESCRIPTION OF THE PREFERRED EMBODIMENTS

Figure 1:
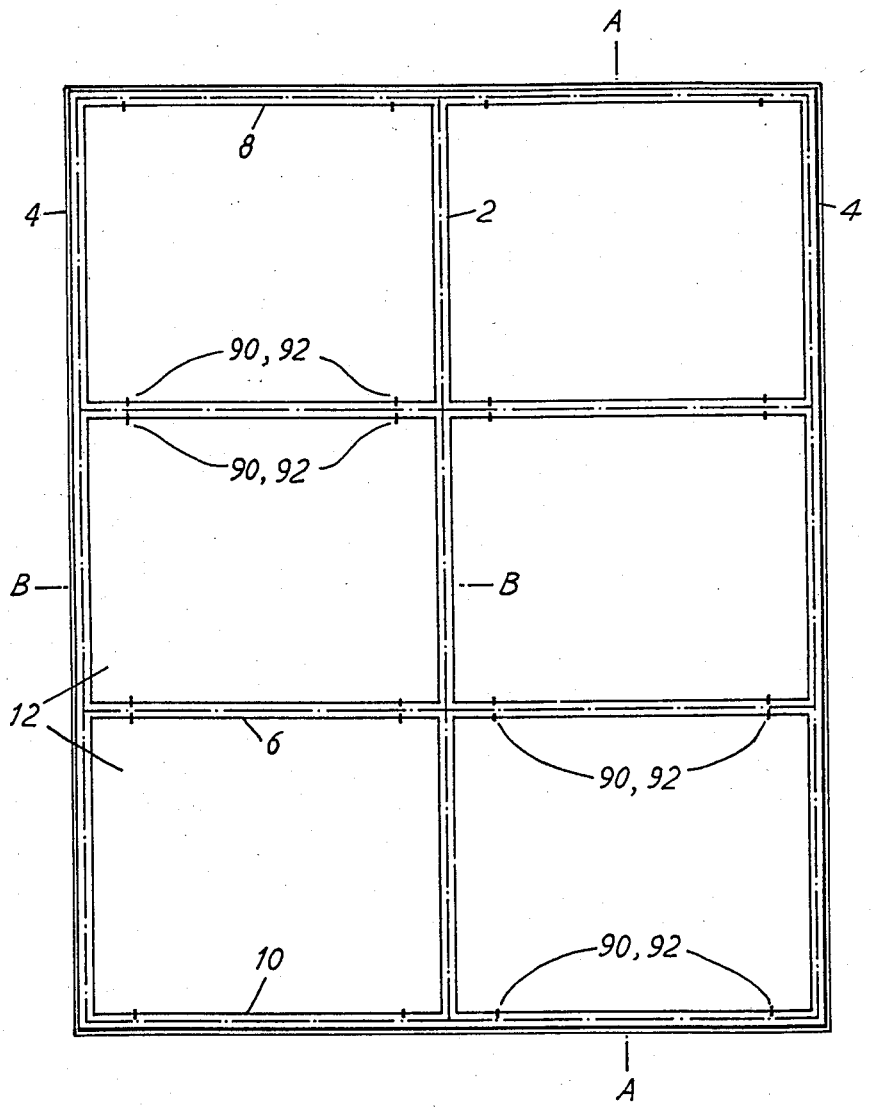
FIG. 1 is an outline illustration of a part of a curtain wall.

FIG. 1 illustrates conventional features of a curtain wall, namely a frame-like construction of vertical mullions 2, including jamb mullions 4 forming the lateral edges of the wall, usually extending continuously through several storeys, and horizontal transoms 6 running between the mullions, with upper and lower sills 8, 10 forming the top and bottom edges of the wall. These members define a series of spaces or cells in which, with the use of further, auxiliary frame members, infill panels 12 (which may be clear, translucent or opaque) are mounted with sealing means at the edges of the cells to make the wall weather-tight. The framing members are typically extruded aluminum sections and examples of similar framing can be seen in GB Pat. Nos. 1459401 and 1496482 and European Application No. 194779, the contents of which are incorporated herein by reference.

Figure 2:
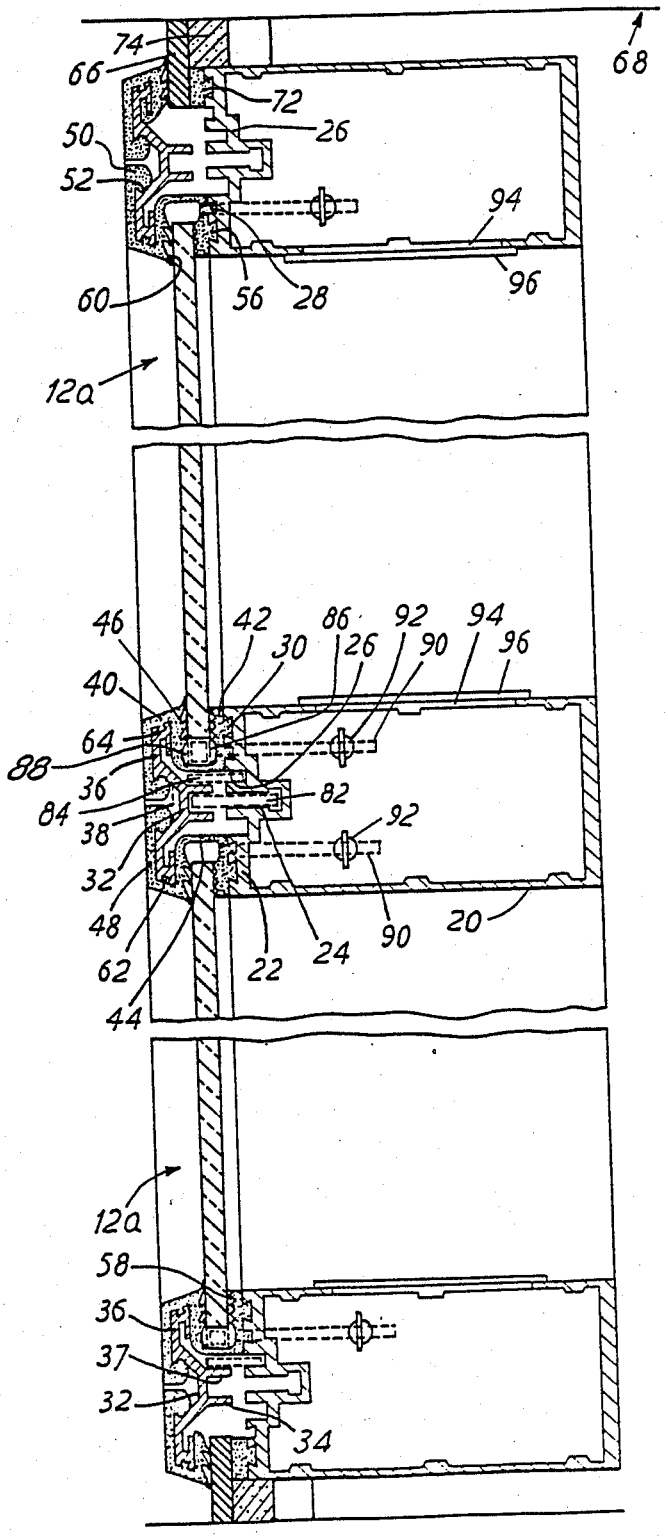
FIGS. 2 and 3 are cross-sectional views on the lines A—A and B—B respectively in FIG. 1, showing a single-layer panel infill.
Figure 3:
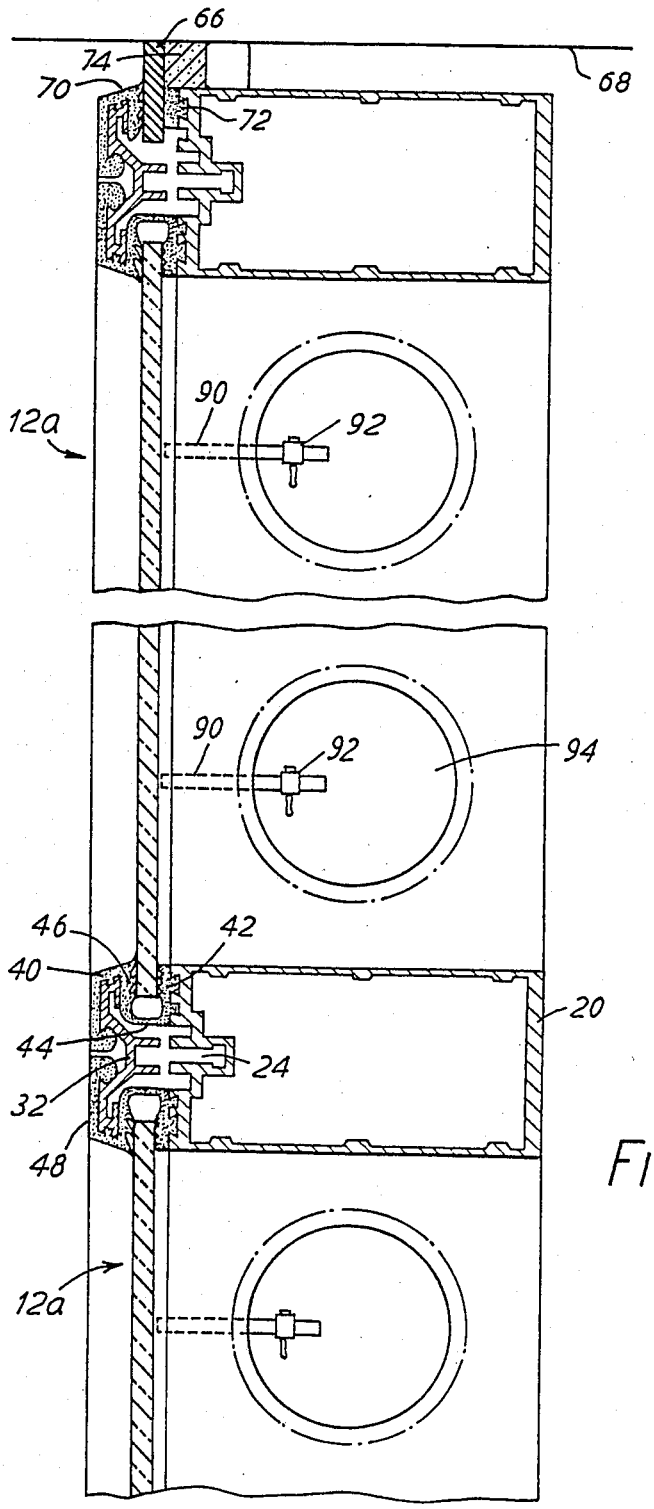

In the more detailed cross-sectional views can be seen a main frame member 20 of symmetrical box section, the same section member being used for the mullions, jamb mullions, transoms and top and bottom sills. The front wall 22 of the member 20 has a parallel-sided central recess 24 with a pair of shallower parallel supplementary recesses 26 to each side of it. These are flanked by a pair of smaller recesses 28 having inclined faces which widen inwardly and, laterally outermost in the front wall, is a pair of dovetail recesses 30. The panel infills of each cell, which in the example of FIGS. 2 and 3 are solid panes or panels 12*a*, are held by their edges between the main frame members and auxiliary frame members 32, generally of a T- or Y-section with a bifurcated central limb 34 extending rearwards from a pair of side limbs 36 that overlap the edges of the panels. The parallel-sided recess 37 in the limb 34 is directly opposite the central recess 24 in the main member front face. Around its rectangular periphery each panel is engaged by a flexible gasket, indicated by the reference 40 in FIGS. 2 and 3, in the form of a continuous loop prepared from a rubbery, e.g. silicone, extrusion of uniform cross-section. The panel is held in place in the cell and the gasket is clamped against its front and rear edges by the auxiliary members which are secured to the main frame members by screws 38 (omitted from the drawings at most positions for clarity).

The cross section of the gasket 40 comprises a rear portion 42 disposed between the main frame members and the rear edge of the panel, and a thin web 44 connecting this integrally to a forward portion 46 disposed between one side limb of the auxiliary members and the front edge of the panel. A continuation 48 of the forward portion extends over the outer edge and the front face of the associated side limbs of the auxiliary members and terminates in a thicker lip 50 which seats in a central recess 52 in the front face of each of the auxiliary members.

The rear portion of the gasket has a dovetail projection 56 on its rear face to locate in the recesses 30 of the frame member front wall, and a series of longitudinal ribs 58 on the front face of this portion bear against the panel to give a more effective seal therewith. The forward portion of the basket comprises a series of rather larger sealing ribs 60, and a dovetail projection 62 in that part of the section overlying the laterally outer edge of the auxiliary member locates in a complementary recess 64 to hold the continuation 48 closely against the front face of the member. In the central recess 52, the opposed lips 50 of two gaskets for the panels of adjacent cells are compressed against each other to form a seal at their abutting faces and are locked in place because of the convergent side faces of that recess. It is also possible to arrange that the lips are locked into the recess by an interposed zipper strip.

At the jamb mullions and the top and bottom sills, flanges 66 fixed to the reveals 68 of the building provide sealing surfaces for the edges of the curtain wall. Separate front and rear gaskets 70, 72 are provided, each essentially the same as the respective front and rear portions 46, 42 of the gaskets 40 but not being connected by an integral web. A supplementary seal is provided between the flanges 66 and the adjacent box-section members 20 by a mastic insertion 74.

The manner of attaching an auxiliary member to its main frame member is generally similar to that described in European application No. 194779 to which reference can be made for further details. Briefly, locating and supporting plates can be interposed between the main and auxiliary members, being wedged in the central and inner pair of recesses 24, 26 of the main members and in the recess 37 provided by the bifurcated central limb 34 of the auxiliary member, or resting on the upper side face of that limb, and before the gasket lips 50 are snapped into place the screws 38 are driven through the auxiliary members to engage the central recess 24 of the main member and so apply a clamping pressure that holds the panels securely and ensures sealing engagement of the gaskets.

In FIG. 2, the transom section shows a locating plate 82 frictionally gripped in the main member central slot 24 and the recess 37 in the rear limb of the auxiliary member; also shown is a supporting plate 84 gripped in the upper of the pair of slots 26 and resting on the limb 34 of the auxiliary member. Two or more plates 84 spaced along the bottom of the cell support each panel, the weight of which is transmitted to the plates by spaced hollow supports 86 inside the space enclosed by the gasket 40.

Along the mullions and the top sill it may be sufficient to use only the locating plates 82, primarily to keep the main and auxiliary members aligned and ensure that the screws 38 crossing the gap between members will run true into the central recesses 24 of the main members.

Because each gasket 40 extends in a continuous loop around its panel 12 and because the forward and rear portions are integrally connected by the web 44, the gasket forms a complete seal, leaving a peripheral space 88 extending continuously around the panel edge since the supports 86 are short hollow elements that do not stop up the space. These peripheral spaces defined by the gaskets are isolated from the internal spaces that exist within the framework, in particular between the main and auxiliary frame members.

There is thus a barrier against penetration of moisture to the edges of the infill and from there to the interior of the curtain wall. In order to determine whether some imperfection of construction has left a leakage path, however, means are provided for pressure testing the gasket seals. For this purpose short tubes 90, two in each horizontal run of a gasket 40, project rearwards through the gasket webs from the internal spaces enclosed by the gaskets to within the hollow box sections of the main frame members where they terminate in closure tap valves 92. Openings 94 closed by detachable inspection covers 96 in the box sections give access to the valved ends of the tubes. By connecting an air pressure supply to one or more of the tubes 90 while the other tubes from a particular space have their valves closed, the fluid-tightness of each gasket can be tested. It will be clear that such tests can be carried out during the initial construction or subsequently, so that if a leak develops after a building has been in use for some time its source can be quickly traced.

The internal spaces within the framework, sealed by the panels, are also sealed from the exterior by the forward portions of the gaskets 40 and by the additional gaskets 70, 72 around the edges of the framework. The possibility exists, of course, that the sealing will not prove to be completely weathertight but the presence of small amounts of water in these spaces is less significant and it is not necessary that they be pressure-tight. If required, there can be drainage holes, in the lower sill for example, to prevent trapped moisture accumulating.

Figure 4:
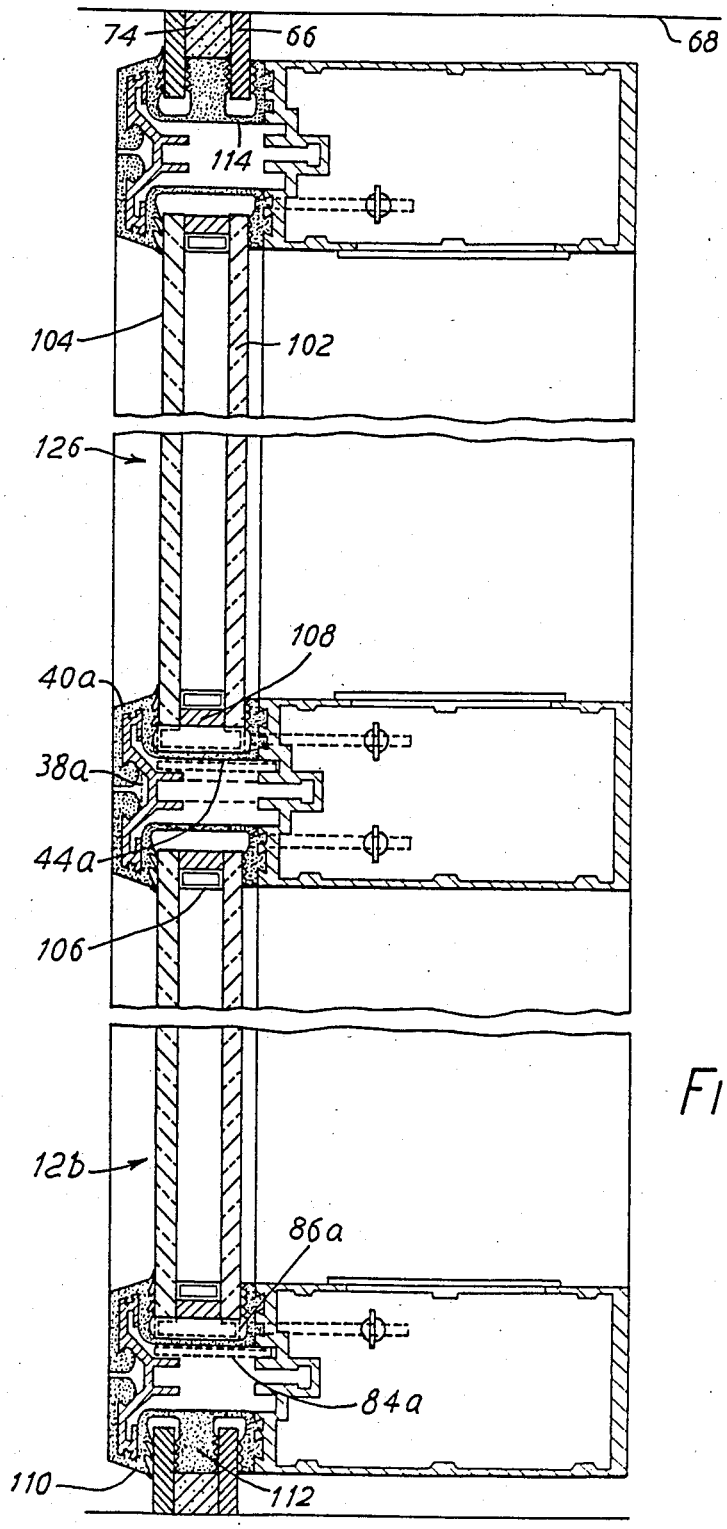
FIGS. 4 and 5 are a similar pair of cross-sectional views showing an infill of pre-sealed double-glazed panels.
Figure 5:
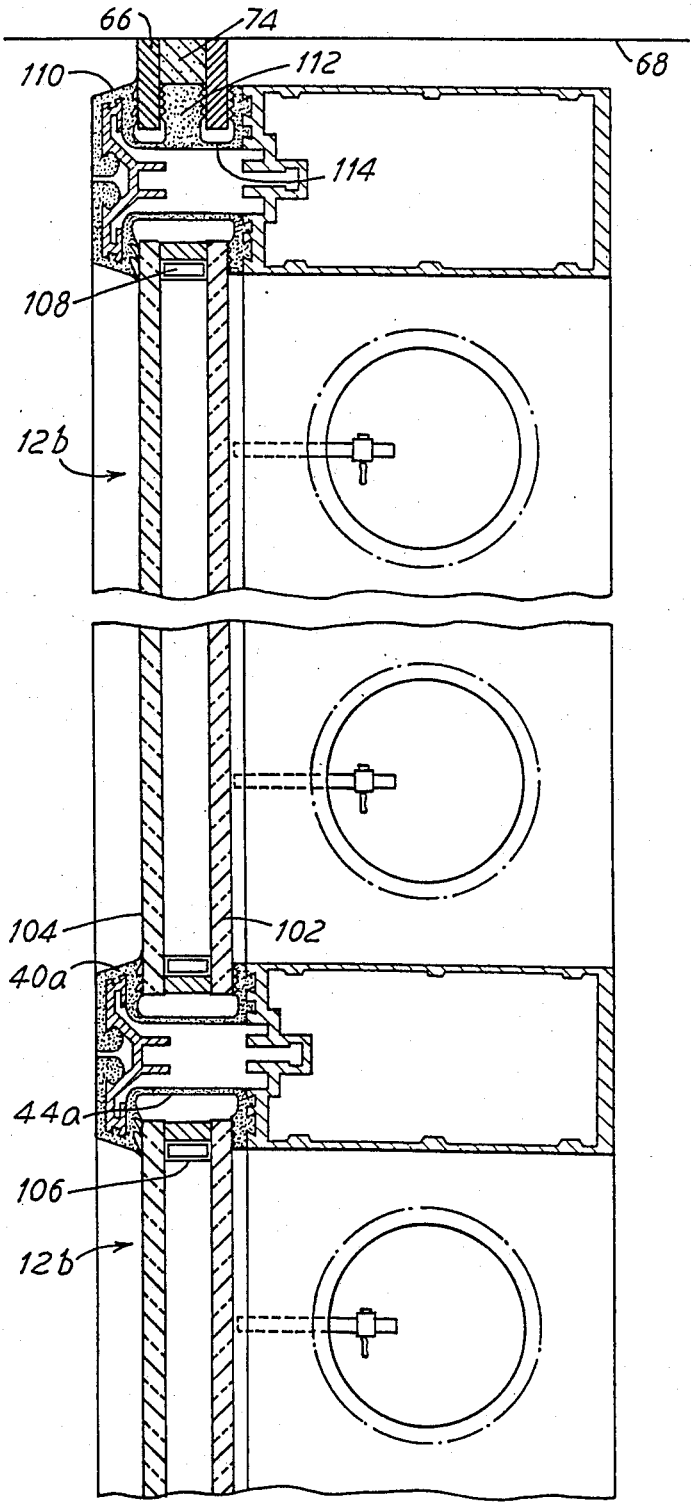

In FIGS. 4 and 5 double-glazed panels **12*b* are shown as the infill, their inner and outer leaves 102, 104 having spacing means 106 and sealing means 108 between them as pre-assembled units. The gasket 40*a* sealing against the front and rear edges of each panel has a section identical to the gasket 40 of the preceding example except for a wider web 44*a* to accommodate the greater thickness of the panel 12*b*. The hollow supports 86*a* at the bottom edges of the panels now have a channel section and the screws 38*a* and the support plates 84*a* are suitably extended. At the edges of the framework a modified section gasket 110 of unitary form is provided, this comprising front and rear portions as before and a ribbed intermediate portion 112 that lies between the pairs of parallel flanges 66 at the reveals 68, all three portions being united by integral webs 114. The space between the intermediate portion and the adjacent reveal surface is filled with sealing mastic 74**. In other respects the construction is the same as that described in the first example.

Figure 6:
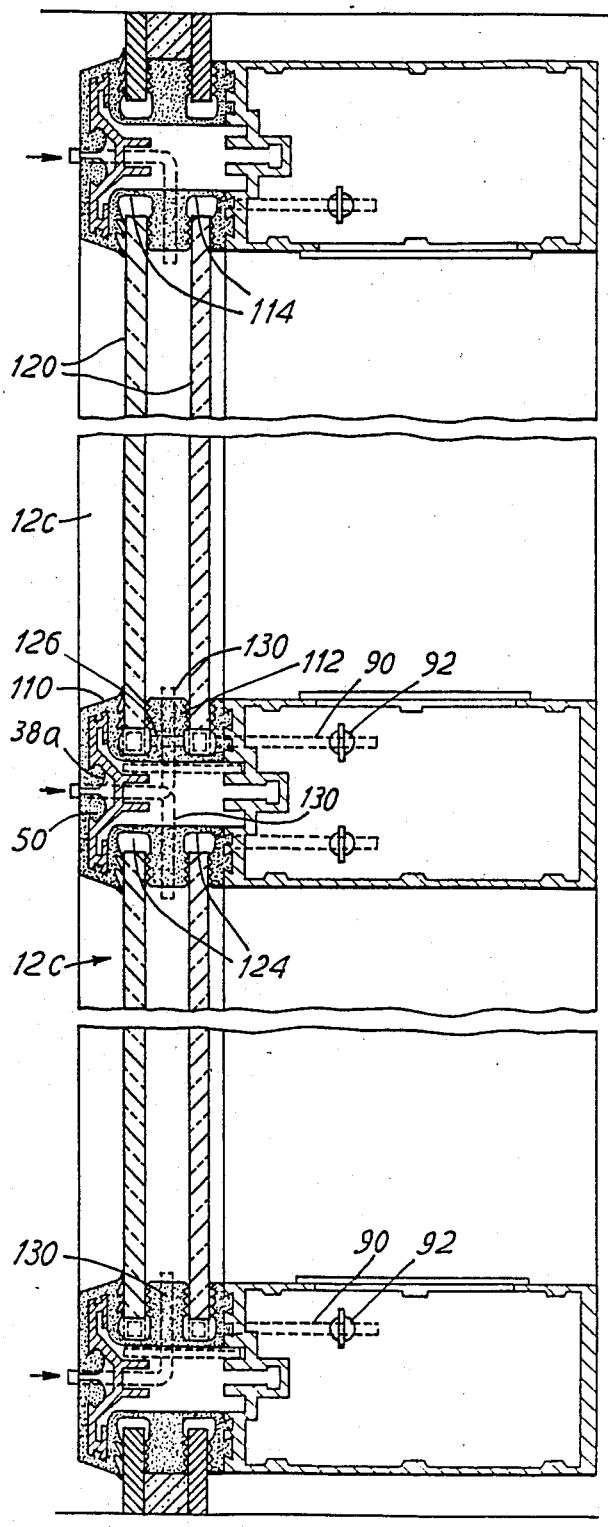
FIGS. 6 and 7 are a similar pair of cross-sectional views showing an infill of double-glazed panels the leaves of which have sealing means interposed between them on site.
Figure 7:
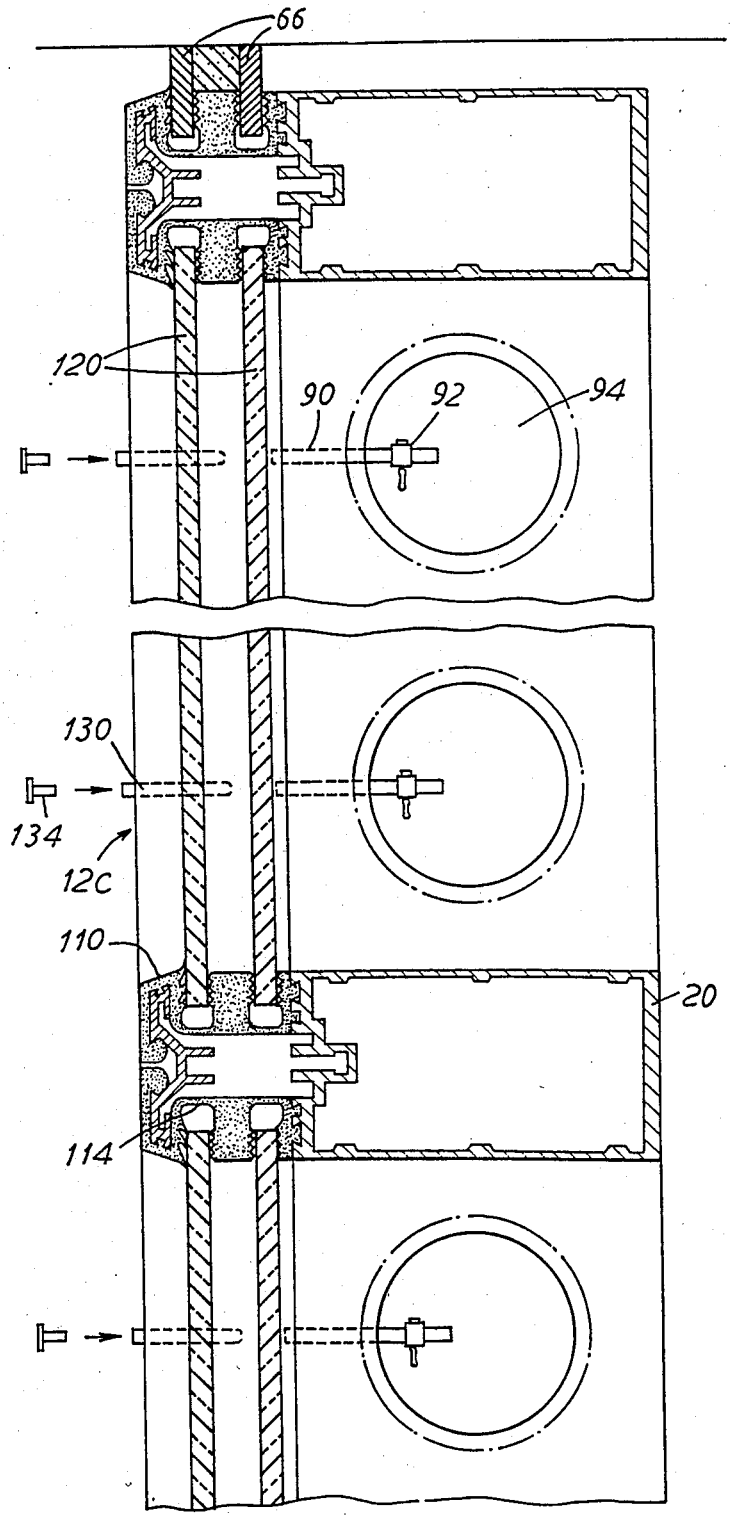

FIGS. 6 and 7 illustrate an alternative form of multiple-leafed or double-glazed panel **12*c* that can utilise the present invention. In this case, the two leaves 120 can be of any sheet-form material separately assembled into place with a gap determined by the peripheral gasket 110, i.e. the peripheral gasket here has the same section as the edge gasket of the preceding example. The intermediate portion 112 of the gasket holds the two leaves apart at a spacing that is determined by the clamping pressure applied by the screws 38*a* and that can therefore be closely controlled. The two peripheral spaces 124 enclosed by the webs 114 are in communication through apertures 126 in the intermediate portion 112. In other respects, the construction is the same as that in the example of FIGS. 4 and 5**.

The sealing integrity of the gasket is tested by means of the tubes 90 with shut-off valves 92 arranged in the same way as the earlier examples described, the peripheral spaces 124 around both the inner and outer leaves being pressurized together because of the connecting apertures 126 through the gasket intermediate portion. The ability of the peripheral gasket around each double-leaved panel cell to provide a sealed enclosure that can be easily tested in situ offers the possibility of substantial savings since factory made pre-sealed and double-glazed panels do not have to be provided.

Because the two leaves of a panel will not be assembled in controlled factory conditions, there is a risk that moisture will be trapped between them, e.g. during assembly in hot and humid weather. Means are therefore provided for venting the interiors of the double-glazed panels comprising angle tubes 130 that have vertical legs projecting into each peripheral space, one from the bottom edge and the other from the top edge, and horizontal legs that extend through holes in the middle of the auxiliary members to the exterior. Water vapour is thus expelled by directing a flow of dry air through the panel using the tubes as inlet and outlet. Further description of means for producing gas flows through the panels is to be found in my co-pending application (Case B, Ser. No. 003415) filed at the same time as this application. Sealing of the limbs of the tubes is assured because they are gripped by the gasket intermediate portion 112 and by the opposed gasket lips 50, and when not in use sealing plugs 134 are inserted in the external ends of the tubes. It will be understood that the tubes are also available for pressure testing the spaces between the inner and outer leaves, for which the outlet tubes are simply left sealed. Similar means can be provided for draining or venting the internal spaces of the framework around the gaskets, if required.

In order to ensure that the panel edges will remain permanently sealed against the entry of moisture, the peripheral space formed by the gasket can be filled with a sealant, in particular a foamed material. Suitable sealants include those known in the art and already used commercially for other purposes and which are of the kind that are applied in a fluent state and that harden in situ to form a waterproof barrier. Such materials could be injected through conduits like the tubes 90. The use of a sealant in this manner is particularly appropriate for ensuring that pre-assembled, pre-sealed, double-glazing panels, as in the example of FIGS. 4 and 5, will retain permanently the water-tightness of the space between the glazing layers. A sealant can also be used with non-sealed multiple-leaved panels such as in the example of FIGS. 6 and 7 but it is necessary first to ensure that no significant amounts of moisture are present in the panels before the sealant is applied. A sealant may also be used with solid or single-leaved panels if the panel edges require to be protected from long-term exposure to condensation.

In those arrangements in which the peripheral gasket encloses a gap between inner and outer layers of a panel it is also possible to utilise the panels as heating and/or cooling means, in particular as solar heating panels. In such cases it is preferably arranged that a liquid flow is provided as the heat transfer medium in the gap between the panel leaves. In a similar manner a preformed hollow panel providing a series of passages can be assembled in curtain walls according to the invention (one example being the product sold under the trade mark CORREX by Corruplast Limited in which a series of parallel rectangular section passages are formed by extruding a sheet with spaced inner and outer walls connected by a series of webs) in the same way as any single-layer panel (e.g. the panels of FIGS. 2 and 3) to provide for the passage of a heat transfer medium; the gasket web then defines header spaces at opposite ends of the parallel passages in the preformed panel and additional conduits at the side edges between those ends. In a modified configuration, the preformed panel can form the spacing means between inner and outer leaves of a panel (e.g. in the panels of FIGS. 6 and 7), or even one half of a double-glazed panel.

I claim:

1. A wall structure comprising a series of frame members forming a plurality of cells or spaces in said structure, multiple-layered infill panels for dividing an interior space from an exterior space, said panels being held in said cells, each panel comprising a pair of panels with an air space between said layers, peripheral regions of said panels and said cells being adjacent each other, and sealing means engaging the panels and the frame members in order to seal between said peripheral regions of the panels and cells, said sealing means comprising a respective flexible sealing member or gasket for each panel in the form of a closed loop extending around the peripheral region of the panel, the cross-section of the sealing member comprising forward and rearward portions that overlap and seal against the forward and rearward margins of said peripheral region of the panel, and a thin web connecting said forward and rearward portions and providing therewith an enclosed space that extends around the periphery of the panel, said periphery having a lower portion whereat the panel rests, via hollow spacer means, upon an associated peripheral extent of the web, said hollow spacer means being interposed between the panel and the web at said lower portion to maintain continuity of said enclosed space therealong, and connection means from the exterior to said enclosed space for the application of gas pressure to said space, whereby to test the integrity of the peripheral seal between the associated gasket and its panel.

2. A structure according to claim 1 wherein said connection means comprises at least two conduits leading to mutually remote regions of said space enclosed by the peripheral sealing member so as to allow a flow of fluid through the space between the layers.

3. A structure according to claim 2 wherein at least one of said conduits serves as a drain for said enclosed peripheral space and leads out of one of the cells from a point in a lower region of the peripheral enclosed space.

4. A structure according to claim 3 comprising a plurality of vertically spaced cells, connecting means between the respective peripheral spaces of said plurality of spaces for drainage from an upper cell to a lower cell, the bottom cell of said plurality having said drain conduit.

5. A structure according to claim 1 wherein drainage outlets are provided in the frame members, externally of said enclosed spaces, for the drainage of water collecting within the structure.

6. A structure according to claim 1 in which at least one of said forward and rearward portions of said sealing members has positive engagement means for location of the member on a rigid support of the structure.

7. A structure according to claim 1 wherein each said peripheral sealing member comprises a frontmost part forming an external facing over rigid frame members of the structure.

8. A structure according to claim 1 wherein a multiple-layered panel forms the infill panel of at least one cell, and spacer means formed integrally with said peripheral sealing member of said panel and holding the layers of said panel apart.

9. A structure according to claim 8 wherein the spacer means provide a peripheral seal around the space between the panel layers and the web of sealing member forms respective enclosed spaces around the periphery of each layer of the panel.

* * * * *